US005349372A

United States Patent [19]

Sellers

[11] Patent Number: 5,349,372

[45] Date of Patent: Sep. 20, 1994

[54] VIDEO SUBSYSTEMS UTILIZING ASYMMETRICAL COLUMN INTERLEAVING

[75] Inventor: Scott D. Sellers, Menlo Park, Calif.

[73] Assignee: Pellucid Inc., Santa Clara, Calif.

[21] Appl. No.: 92,702

[22] Filed: Jul. 16, 1993

[51] Int. Cl.[5] ..... G09G 3/00

[52] U.S. Cl. ..... 345/185; 345/200; 345/164

[58] Field of Search ..... 395/164, 166, 400; 345/185, 200; 358/293

[56] References Cited

U.S. PATENT DOCUMENTS

| | | | |
|---|---|---|---|
| 4,571,638 | 2/1986 | Schneider et al. | 358/293 |
| 4,731,742 | 3/1988 | Nishi et al. | 395/166 |
| 4,931,958 | 6/1990 | Takeda | 345/200 X |
| 4,933,877 | 6/1990 | Hasebe | 395/166 X |
| 4,941,110 | 7/1990 | Bassman | 345/200 X |
| 4,975,857 | 12/1990 | Katsura et al. | 345/185 |
| 5,255,366 | 10/1993 | Chia et al. | 395/166 |

*Primary Examiner*—Ulysses Weldon
*Attorney, Agent, or Firm*—Elmer Galbi

[57] ABSTRACT

This is a method and apparatus for interleaving data in a VRAM. A video card is provided which has less VRAMs than the equivalent prior art video cards which have the same speed and same size data paths. Herein is utilized non symmetrical column interleaving whereby each pixel on the display having coordinates X, and Y is mapped into the VRAMS rows and columns R and C according to the formula:

$$R=[TTI \text{ of } 2(Y/3)]+P1$$

$$C=LNB\{[(TTI \text{ of } Y \bmod 3)\ 341]+[TTI \text{ of } X/3]\}$$

where:

TTI means truncation to an integer

LNB means lower nine order bits of P1 is "1" if [((X>511) and (Y mod 3=1)) or (Y mod 3=2)]

Utilizing the asymmetrical column interleaving of the method and apparatus the rows of each VRAM are completely filled and one can produce a video card for 1024 by 768 display with 8 bits per pixel utilizing three 2 megabit VRAMS.

5 Claims, 6 Drawing Sheets

FIGURE 1 - Prior Art

PRIOR ART VIDEO CARD

FIGURE 3A (Prior Art)

1024 by 768 by 8 SVGA display,
Four way interleave with four 512 by 512 VRAMS

Display row ZERO:

| Display Column: | 0 | 1 | 2 | 3 | 4 | 5 | 6 | 7 | 8 | 9 | 10 | 11 | 12 ..... | 1019 | 1020 | 1021 | 1022 | 1023 |
|---|---|---|---|---|---|---|---|---|---|---|---|---|---|---|---|---|---|---|
| VRAM: | VR1 | VR2 | VR3 | VR4 | VR1 | VR2 | VR3 | VR4 | VR1 | VR2 | VR3 | VR4 | VR1 | VR4 | VR1 | VR2 | VR3 | VR4 |
| VRAM row,column: | 0,0 | 0,0 | 0,0 | 0,0 | 0,1 | 0,1 | 0,1 | 0,1 | 0,2 | 0,2 | 0,2 | 0,2 | 0,3 | 0,254 | 0,255 | 0,255 | 0,255 | 0,255 |

Display row ONE:

| Display Column: | 0 | 1 | 2 | 3 | 4 | 5 | 6 | 7 | 8 | 9 | 10 | 11 | 12 ..... | 1019 | 1020 | 1021 | 1022 | 1023 |
|---|---|---|---|---|---|---|---|---|---|---|---|---|---|---|---|---|---|---|
| VRAM: | VR1 | VR2 | VR3 | VR4 | VR1 | VR2 | VR3 | VR4 | VR1 | VR2 | VR3 | VR4 | VR1 | VR4 | VR1 | VR2 | VR3 | VR4 |
| VRAM row,column: | 0,256 | 0,257 | 0,258 | 0,259 | 0,260 | 0,261 | 0,262 | 0,263 | 0,264 | 0,265 | 0,266 | 0,267 | 0,268 | 0,510 | 0,511 | 0,511 | 0,511 | 0,511 |

Display row TWO:

| Display Column: | 0 | 1 | 2 | 3 | 4 | 5 | 6 | 7 | 8 | 9 | 10 | 11 | 12 ..... | 1019 | 1020 | 1021 | 1022 | 1023 |
|---|---|---|---|---|---|---|---|---|---|---|---|---|---|---|---|---|---|---|
| VRAM: | VR1 | VR2 | VR3 | VR4 | VR1 | VR2 | VR3 | VR4 | VR1 | VR2 | VR3 | VR4 | VR1 | VR4 | VR1 | VR2 | VR3 | VR4 |
| VRAM row,column: | 1,0 | 1,0 | 1,0 | 1,0 | 1,1 | 1,1 | 1,1 | 1,1 | 1,2 | 1,2 | 1,2 | 1,2 | 1,3 | 1,254 | 1,255 | 1,255 | 1,255 | 1,255 |

Display row THREE:

| Display Column: | 0 | 1 | 2 | 3 | 4 | 5 | 6 | 7 | 8 | 9 | 10 | 11 | 12 ..... | 1019 | 1020 | 1021 | 1022 | 1023 |
|---|---|---|---|---|---|---|---|---|---|---|---|---|---|---|---|---|---|---|
| VRAM: | VR1 | VR2 | VR3 | VR4 | VR1 | VR2 | VR3 | VR4 | VR1 | VR2 | VR3 | VR4 | VR1 | VR4 | VR1 | VR2 | VR3 | VR4 |
| VRAM row,column: | 1,256 | 1,257 | 1,258 | 1,259 | 1,260 | 1,261 | 1,262 | 1,263 | 1,264 | 1,265 | 1,266 | 1,267 | 1,268 | 1,510 | 1,511 | 1,511 | 1,511 | 1,511 |

Display row 767:

| Display Column: | 0 | 1 | 2 | 3 | 4 | 5 | ..... | 1019 | 1020 | 1021 | 1022 | 1023 |
|---|---|---|---|---|---|---|---|---|---|---|---|---|
| VRAM: | VR1 | VR2 | VR3 | VR4 | VR1 | VR2 | | VR4 | VR1 | VR2 | VR3 | VR4 |
| VRAM row,column: | 384,256 | 384,257 | 384,258 | 384,259 | 384,260 | 384,261 | | 384,510 | 384,511 | 384,511 | 384,511 | 384,511 |

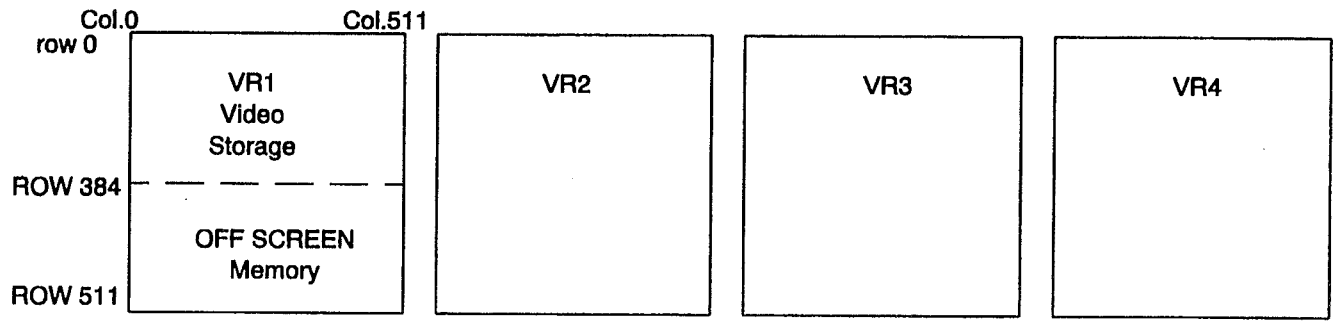

FIGURE 3B (Prior Art)

FIGURE 4A

Asymetrical Interleave 1024 by 768 by 8 SVGA display
Three way interleave with three 512 by 512 VRAMS Display row ZERO:

| | | | | | | | | | | | | | | | | | | |
|---|---|---|---|---|---|---|---|---|---|---|---|---|---|---|---|---|---|---|
| Display Column: | 0 | 1 | 2 | 3 | 4 | 5 | 6 | 7 | 8 | 9 | 10 | 11 | 12 ---- | 1019 | 1020 | 1021 | 1022 | 1023 |
| VRAM: | VR1 | VR2 | VR3 | VR1 | VR2 | VR3 | VR1 | VR3 | VR3 | VR1 | VR2 | VR3 | VR1 | VR3 | VR1 | VR2 | VR3 | VR1 |
| VRAM row,column: | 0,0 | 0,0 | 0,0 | 0,1 | 0,1 | 0,1 | 0,2 | 0,2 | 0,2 | 0,3 | 0,3 | 0,3 | 0,4 | 0,339 | 0,340 | 0,340 | 0,340 | 0,341 |

Display row ONE:

| | | | | | | | | | | | | | | | | | | |
|---|---|---|---|---|---|---|---|---|---|---|---|---|---|---|---|---|---|---|
| Display Column: | 0 | 1 | 2 | 3 | 4 | 5 | 6 | 7 | 8 | 9 | 10 | 11 | 12 ---- | 1019 | 1020 | 1021 | 1022 | 1023 |
| VRAM: | VR2 | VR3 | VR1 | VR2 | VR3 | VR1 | VR2 | VR3 | VR1 | VR2 | VR3 | VR1 | VR2 | VR1 | VR2 | VR3 | VR1 | VR2 |
| VRAM row,column: | 0,341 | 0,341 | 0,342 | 0,342 | 0,342 | 0,343 | 0,343 | 0,343 | 0,344 | 0,344 | 0,344 | 0,345 | 0,345 | 1,170 | 1,170 | 1,170 | 1,171 | 1,171 |

Display row TWO:

| | | | | | | | | | | | | | | | | | | |
|---|---|---|---|---|---|---|---|---|---|---|---|---|---|---|---|---|---|---|
| Display Column: | 0 | 1 | 2 | 3 | 4 | 5 | 6 | 7 | 8 | 9 | 10 | 11 | 12 --- | 1019 | 1020 | 1021 | 1022 | 1023 |
| VRAM: | VR3 | VR1 | VR2 | VR3 | VR1 | VR2 | VR3 | VR1 | VR2 | VR3 | VR1 | VR2 | VR3 | VR2 | VR3 | VR1 | VR2 | VR3 |
| VRAM row,column: | 1,171 | 1,172 | 1,172 | 1,172 | 1,173 | 1,173 | 1,173 | 1,174 | 1,174 | 1,174 | 1,175 | 1,175 | 1,175 | 2,510 | 2,510 | 2,511 | 2,511 | 2,511 |

Display row THREE:

| | | | | | | | | | | | | | | | | | | |
|---|---|---|---|---|---|---|---|---|---|---|---|---|---|---|---|---|---|---|
| Display Column: | 0 | 1 | 2 | 3 | 4 | 5 | 6 | 7 | 8 | 9 | 10 | 11 | 12 ---- | 1019 | 1020 | 1021 | 1022 | 1023 |
| VRAM: | VR1 | VR2 | VR3 | VR1 | VR2 | VR3 | VR1 | VR2 | VR3 | VR1 | VR2 | VR3 | VR1 | VR3 | VR1 | VR2 | VR3 | VR1 |
| VRAM row,column: | 3,0 | 3,0 | 3,0 | 3,1 | 3,1 | 3,1 | 3,2 | 3,2 | 3,2 | 3,3 | 3,3 | 3,3 | 3,4 | 3,339 | 3,340 | 3,340 | 3,340 | 3,341 |

Display row 767:

| | | | | | | | | | | |
|---|---|---|---|---|---|---|---|---|---|---|
| Display Column: | 0 | 1 | 2 | 3 | 4 | 5 | ---------- | 1019 | 1020 | 1021 | 1022 | 1023 |
| VRAM: | VR3 | VR2 | VR3 | VR4 | VR1 | VR2 | | VR2 | VR1 | VR1 | VR2 | VR3 |
| VRAM row,column: | 511,172 | 511,173 | 511,173 | 511,173 | 511,174 | 511,174 | | 511,510 | 511,510 | 511,511 | 511,511 | 511,511 |

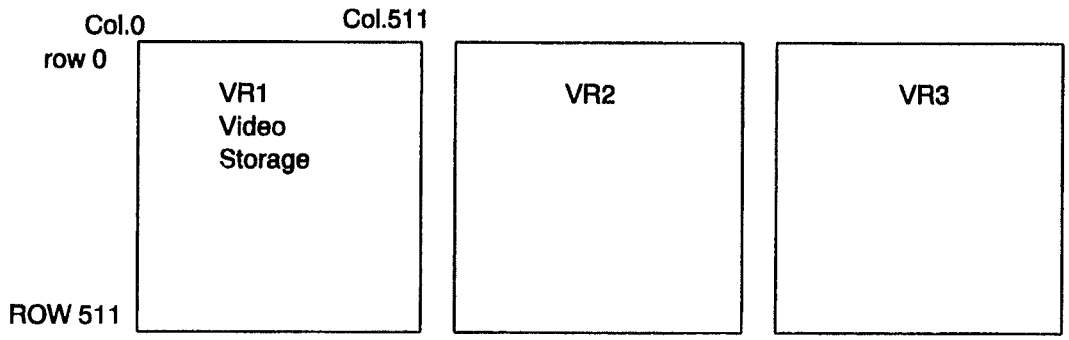

FIGURE 4B

VIDEO SUBSYSTEMS UTILIZING ASYMMETRICAL COLUMN INTERLEAVING

FIELD OF THE INVENTION

The present invention relates to computers and more particularly to video subsystems for computers.

BACKGROUND OF THE INVENTION

Most small computer systems include a video subsystem which interfaces the computer's system unit to the computer's display. Video subsystems are often built on a separate card called a "video card". Examples of small computer systems that include video subsystems or video cards are (a) personal computers generally termed "IBM compatible" personal computers, (b) work stations such as those marked by SUM Microsystems Inc., and Silicon Graphics Inc., and (c) the Macintosh brand of computers which are marketed Apple computer Corp.

A video subsystem or a video card generally includes memory (termed video memory) which stores the information displayed at any particular time. The display is updated from the stored information relatively frequently, for example, every 0.015 seconds. The display is updated from information stored in the video memory. That is, the information stored in the video memory is periodical used to update the display. The video memory is generally in the form of Dynamic Random Access Memory (DRAM) chips, or in the form Video Random Access Memory (i.e. VRAM) chips. The DRAMS or the VRAMS used in a video subsystem must be relatively fast and relatively dense devices which are therefore relatively expensive devices.

Since personal computers became popular in the 1980–85 time frame, video subsystems have progressed through a number of informal or de facto standards. One of the first informal standards was the CGA (Color Graphics Adapter) which has a resolution of 320 by 240 pixels. Next came the EGA (Enhanced Graphics Adapter) with a resolution up to 640 by 350 and then the VGA (Video Graphics Adapter) with have a resolution of 640 by 480 pixels. Today many advanced commercially available computers have display subsystems or video cards that support SVGA (Super VGA) displays. SVGA display generally have 1024 columns and 768 rows (i.e. 786,432 pixels).

In addition to the resolution (i.e. the number of rows and columns or pixels) of a display one must consider the range colors or depth of each pixel. Each pixel on a display can have 8, 12 or 24 associated bits which define the color (or depth) of the pixel. For example a display that uses 8 bits to define the color of each pixel, can set each pixel to one of 256 colors. Displays that use 24 bits to define the color of each pixel can set each pixel to one of 16.7 million colors. A display that uses 24 bits to define the color of each pixel is termed a "true color" display.

The amount of memory on a video card (i.e. the number of VRAMS required) is a direct function of the number of pixels in the display and the number of bits of information used to define the color of each pixel.

There are a wide variety of commercially available video subsystems. For example, ten commercially available video subsystems (i.e. video cards) that interface to the local bus; in a personal computer are described in an article entitled "Local-bus Graphic boards, the engine that makes Windows fly", published in the magazine "Windows Sources" April 1993 Page 362. Other descriptions of commercially available video subsystems are found in articles entitled "Video Cards Revisited" and "Benchmark Tests: Video Accelerator Boards" which were published in the July 1993 issue of "PC Magazine" at pages 165 and 251. A list of ninety three commercially available video cards produced by twenty five different companies is given in article entitled "Speed Demons" which appeared at page 47 of "*InfoWorld Direct -A Supplement to InfoWorld*".

In order to increase speed, many of the video subsystems which are commercially available store information about adjacent pixels in different VRAMS, that is, many commercially available video cards use either two, four, or eight way interleaving. For example, with four way interleaving, four VRAMS are used and information concerning the various pixels on the display is stored in the VRAM as follows:

First VRAM, pixels 0, 4, 8, 12, etc.
Second VRAM, pixels, 1, 5, 9, 13, etc,
Third VRAM, pixels 2, 6, 10, 14, etc,
Fourth VRAM, pixels 3, 7, 11, 15, etc,.

Commercially available VRAMS are sold as being either 1, 2 or 4 megabit VRAMS; however, such VRAM do not have exactly 1, 2, or 4 megabits of storage. For example, commercially available 2 megabit VRAMs actually have 2,097,152 bits of storage arranged in 512 rows, 512 columns, and with 8 bits per position. A video card that includes four 2 meg VRAMS therefore has a total of 8,308,608 bits of storage. A 1024 by 768 display which uses 8 bits per pixel requires, 1024 time 785 times 8, bits of storage, (that is, 6,291,456 bits of storage) to store the information displayed.

Commercially available video cards which use four way interleaving have four VRAMS. Four example, commercially available video subsystems which utilize four way interleaving for 1024 by 768 displays with 8 bits per Pixel have 2,017,152 bits of storage which is not used for video refresh. Using conventional two, four, or eight way interleaving it is not possible to efficiently utilize all of the space in commercially available VRAMS. Many of the commercially available video subsystems attempt to utilize this memory, which is termed "off screen" memory for other purposes. For example in the above article entailed "Local-bus Graphic boards, the engine that makes Windows fly", states at page 365 "Designers try to find things to do with the extra memory. Some . . . use if for off screen caching and for storing the pattern of a hardware cursor".

The present invention provides a novel type of interleaving which more efficiently utilizes the storage space in VRAMS and therefore reduces the number of VRAMS needed for the equivalent type of video card.

SUMMARY OF THE PRESENT INVENTION

The present invention provides a method and apparatus for interleaving data in a VRAM. The present invention also provides a video card which has less VRAMs than the equivalent prior art video cards which have the same speed and same size data paths. The present invention utilizes non symmetrical column interleaving whereby each pixel on the display having coordinates X, and Y is mapped into the VRAMS rows and columns R and C according to the formula:

$$R=[TTI \text{ of } 2(Y/3)]+P1$$

$$C=LNB\{[(TTI \text{ of } Y \bmod 3)\ 341]+[TTI \text{ of } X/3]\}$$

where:

TTI means truncation to an integer

LNB means lower nine order bits of P1 is "1" if [((X>511) and (Y mod 3=1)) or (Y mod 3=2)]

Utilizing the asymmetrical column interleaving of the present invention the rows of each VRAM are completely filled. The preferred embodiment shown herein controls a 1024 by 768 display which has 8 bits per pixel. With the present invention the video subsystem can utilize three 2 megabit VRAMS. The comparable prior art video subsystems require 4 two megabit VRAMS. The present invention therefore results in a twenty five percent savings in the cost of VRAM cost over the video subsystems presently on the market.

BRIEF DESCRIPTION OF THE FIGURES

FIG. 3A is a diagram showing how the prior art utilizes four VRAMS.

FIG. 3B shows the OFF screen storage in a conventional system.

FIG. 4A is a diagram showing the non-symmetrical column interleaving of the present invention.

FIG. 4B shows the VRAMS used with one embodiment of the present invention.

DETAILED DESCRIPTION OF A PREFERRED EMBODIMENT

Figure 1:
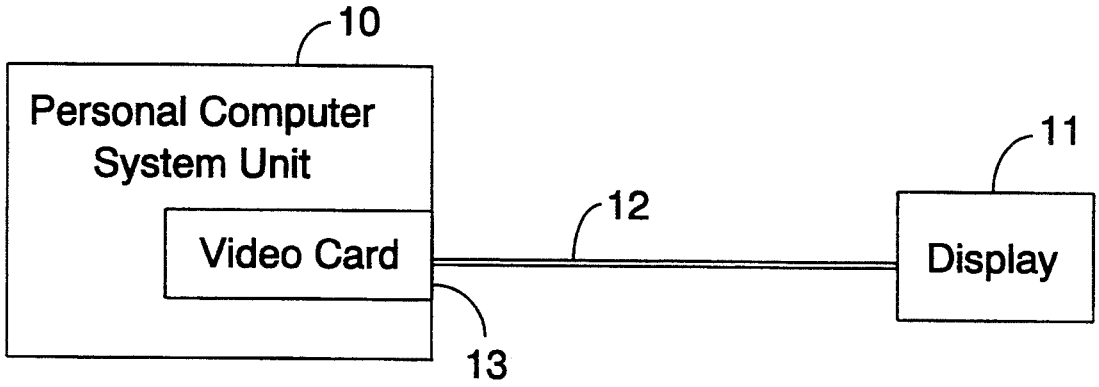
FIG. 1 is an overall FIGURE of a IBM compatible personal computer.

An overall diagram of a conventional personal computer is shown in FIG. 1. A system unit 10 is connected to a display 11 by a cable 12. A video card 13 interfaces the display 11 to the system unit 10. The present invention related to the design of the video card 13.

Figure 2:
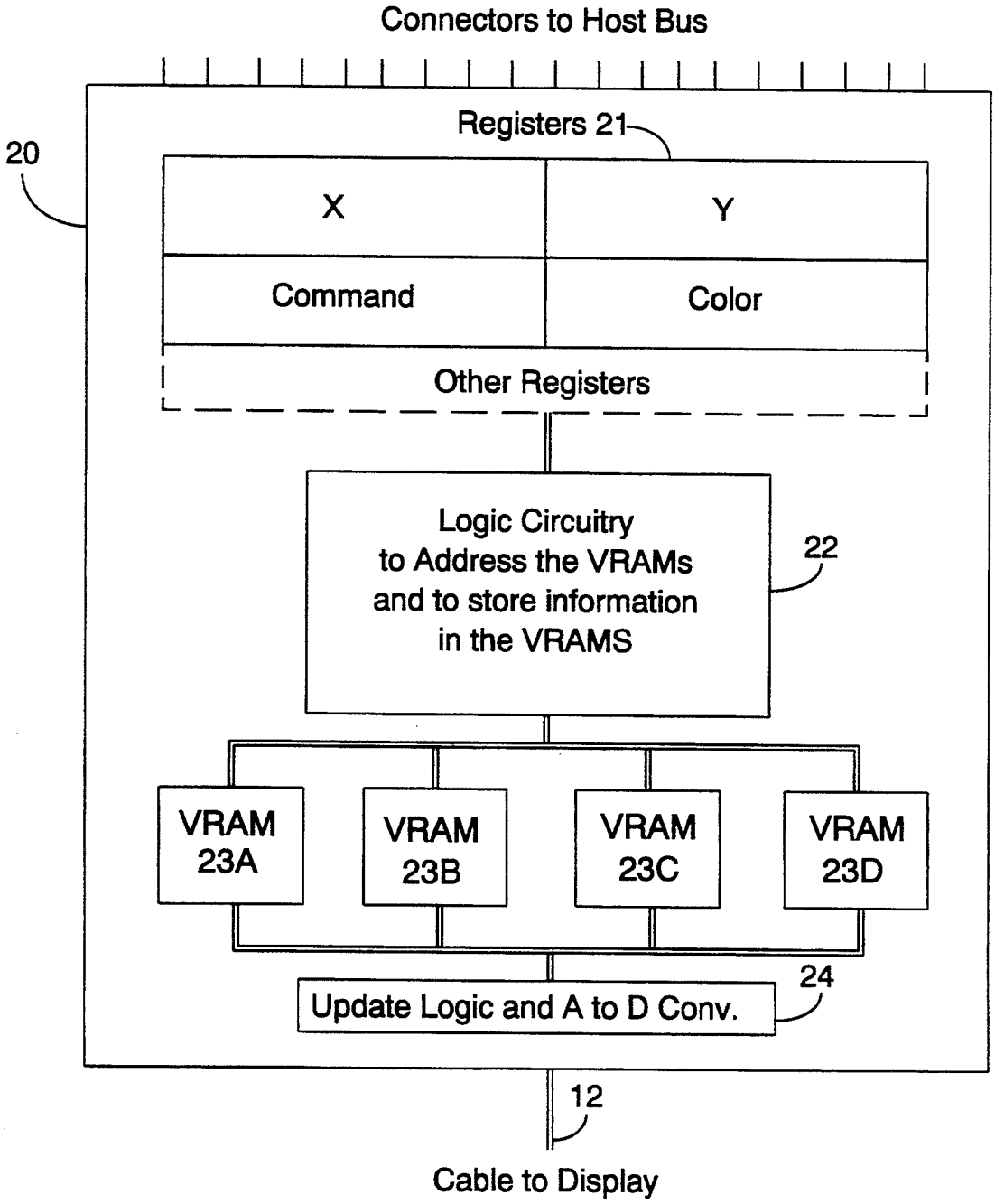
FIG. 2 is a block diagram of a video card.

The overall design of a prior art video card is shown in FIG. 2. The video card connects to the computer's system unit via connectors 20A which connect to a bus such as the AT BUS or the Local Bus. These buses are conventional parts of a personal computer. The interface between the video card and the personal computer forms no part of the present invention.

The main elements in a conventional video cards are control registers 21, logical circuitry 22 , VRAMS 23, Update and Digital to analog circuitry 24 and an output cable 12 which connects to the computers display. Registers 21 receive information and commands from the system unit and pass this information to circuitry 22. Circuitry 22 determines what information should be stored in the VRAMS and it then addresses the VRAMS and stores this information in the VRAMS. Circuitry 24 periodically takes the information from the VRAMS 23, converts it to analog form and passes it to the display via cable 12.

FIG. 3 illustrates the manner in which a prior art video card with four way interleaving and a 1024 by 768 by 8 display maps data from four 512 by 512 VRAMs to the display. The manner that each pixel on the display is mapped into the VRAMS is illustrated below:

| DISPLAY PIXEL | | VRAM | | VRAM where Information |
|---|---|---|---|---|
| Row | Column | Row | Column | Stored |
| 0 | 0 | 0 | 0 | VR1 |
| 0 | 1 | 0 | 0 | VR2 |
| 0 | 2 | 0 | 0 | VR3 |
| 0 | 3 | 0 | 0 | VR4 |
| 0 | 4 | 0 | 1 | VR1 |
| 0 | 5 | 0 | 1 | VR2 |
| 0 | 6 | 0 | 1 | VR3 |
| 0 | 7 | 0 | 1 | VR4 |
| 0 | 8 | 0 | 2 | VR1 |
| . | | | | |
| . | | | | |
| . | | | | |
| 0 | 1019 | 0 | 254 | VR4 |
| 0 | 1020 | 0 | 255 | VR1 |
| 0 | 1021 | 0 | 255 | VR2 |
| 0 | 1022 | 0 | 255 | VR3 |
| 0 | 1023 | 0 | 255 | VR4 |
| 1 | 0 | 0 | 256 | VR1 |
| 1 | 1 | 0 | 256 | VR2 |
| 767 | 1019 | 384 | 510 | VR4 |
| 767 | 1020 | 384 | 511 | VR1 |
| 767 | 1021 | 384 | 511 | VR2 |
| 767 | 1022 | 384 | 511 | VR3 |
| 767 | 1023 | 384 | 511 | VR4 |

As illustrated in FIG. 4B, with conventional four way interleaving the part of the VRAM from row 384 to 511 is termed OFF screen memory and it is not used to store video information. As explained some prior art devices attempt to use this extra memory for other purposes. However, such use is inherently ineffective in that lower cost memory could be used for such purposes.

FIG. 4A show the way the VRAMS are mapped to the display using the asymmetrical interleaving technique of the present invention. With the present invention the rows of the display are not symmetrically mapped to the rows of the VRAMS. For example in the specific example shown in FIG. 3A, the last bit in each row is not mapped to the same VRAM. With conventional interleaving as shown in FIG. 3A the last row of the display is always mapped to VRAM VR4. With asymmetrical interleaving of the present invention the display is mapped to the VRAMs as follows:

| DISPLAY PIXEL | | VRAM | | VRAM where Information |
|---|---|---|---|---|
| Row | Column | Row | Column | Stored |
| 0 | 0 | 0 | 0 | VR1 |
| 0 | 1 | 0 | 0 | VR2 |
| 0 | 2 | 0 | 0 | VR3 |
| 0 | 3 | 0 | 1 | VR1 |
| 0 | 4 | 0 | 1 | VR2 |
| 0 | 5 | 0 | 1 | VR3 |
| 0 | 6 | 0 | 2 | VR1 |
| 0 | 7 | 0 | 2 | VR2 |
| 0 | 8 | 0 | 2 | VR3 |
| . | | | | |
| . | | | | |
| . | | | | |
| 0 | 1019 | 0 | 339 | VR3 |
| 0 | 1020 | 0 | 340 | VR1 |
| 0 | 1021 | 0 | 340 | VR2 |
| 0 | 1022 | 0 | 340 | VR3 |
| 0 | 1023 | 0 | 341 | VR1 |
| 1 | 0 | 0 | 341 | VR2 |
| 1 | 1 | 0 | 341 | VR3 |
| 767 | 1019 | 511 | 510 | VR2 |
| 767 | 1020 | 511 | 510 | VR3 |

-continued

| DISPLAY PIXEL | | VRAM | | VRAM where Information |
|---|---|---|---|---|
| Row | Column | Row | Column | Stored |
| 767 | 1021 | 511 | 511 | VR1 |
| 767 | 1022 | 511 | 511 | VR2 |
| 767 | 1023 | 511 | 511 | VR3 |

The rows and column in the VRAM (R and C) are defined from the X and Y row bits according to the following equations:

$$R=[\text{TTI of } 2(Y/3)]+P1$$

$$C=LNB\{[(\text{TTI of } Y \bmod 3)\ 341]+[\text{TTI of } X/3]\}$$

where:

TTI means truncation to an integer

LNB means lower nine order bits of P1 is "1" if [((X>511) and (Y mod 3=1)) or (Y mod 3=2)]

In considering the above equations, note that (a) "1024" divided by "3" is "341", (b) the initial X and Y address is a conventional twenty bit address with ten X bits and ten Y bits (c) when a ten bit number is divided by 3, the result is an eight bit number, and (d) when a ten bit number is put in Mod 3 form the result is a two bit number which has values of either 00, 01 or 10.

With the present invention there is no Off screen memory and the VRAMS are completely filled. In the example given herein for a system with eight bits per pixel, the asymmetrical interleaving of the present invention saves the cost of one VRAM. If the embodiment had sixteen bits per pixel, two VRAMS would be saved. If the embodiment had twenty four bits per pixel, three VRAMS would be saved. That is in what is termed a "true color" display with twenty four bits per pixel, the three way interleaving of the present invention would utilize nine VRAMS compared to the use of twelve VRAMS with conventional four way interleaving. This is very significant in the overall cost of the video subsystem.

Figure 5:
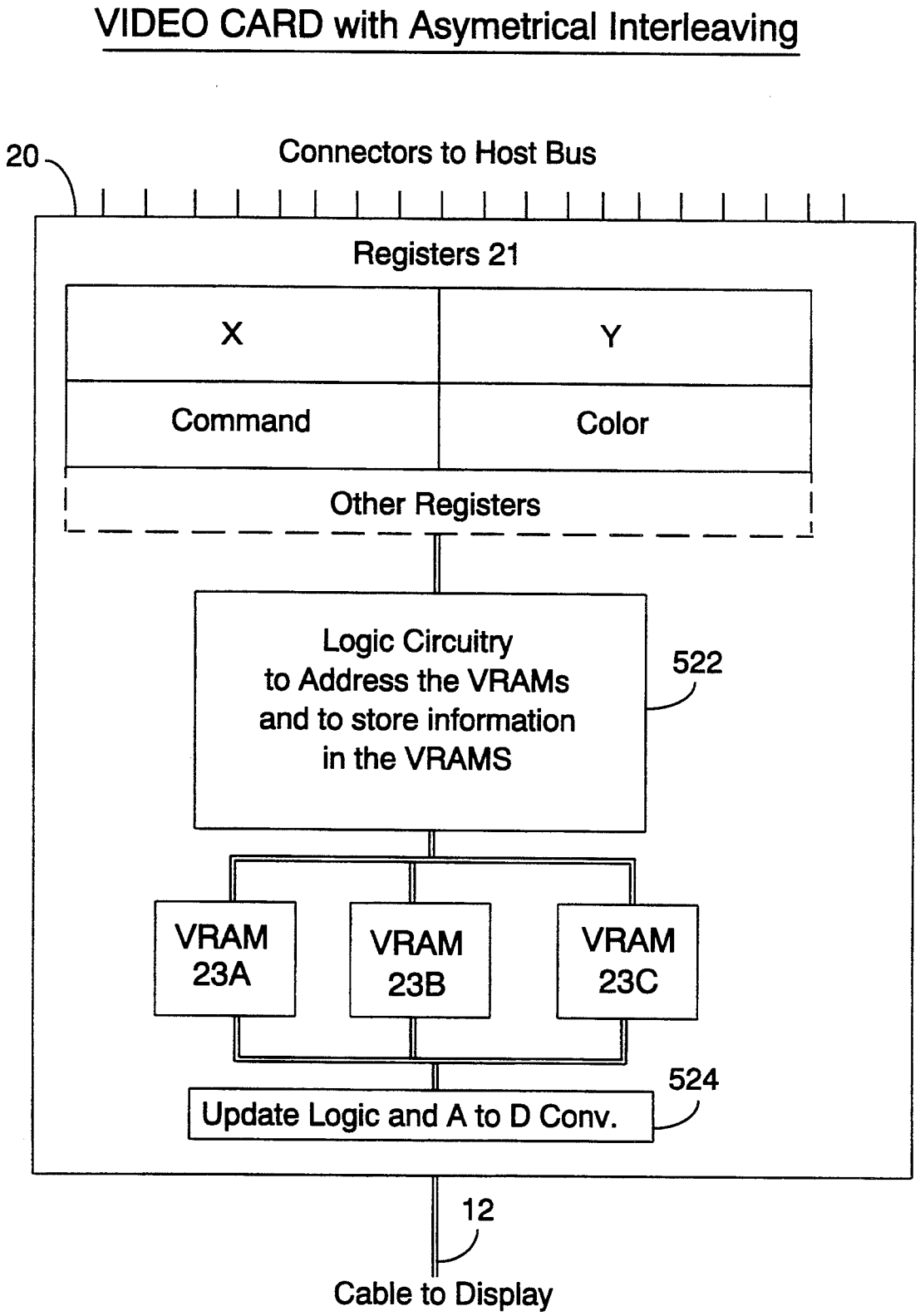
FIG. 5 is a block diagram of a video card which employs the present invention.

FIG. 5 shows a block diagram of a video card which embodies the present invention. The differences in the video card shown in FIG. 5 from the prior art video card shown in FIG. 2 are in circuit 522, VRAMS 523 and circuity 524. The VRAMs are identical except that there are three VRAMS instead of four.

With the card shown in FIG. 2, when the circuitry 22 calculates the value of a pixel, the information is stored in the VRAMS according to the simple symmetrical pattern shown in FIG. 3A. Likewise when circuit 24 transfers information from the VRAMS to the display, the mapping is done according to the simple pattern shown in FIG. 3.

With the present invention, when circuitry 522 calculates the value of a pixel, it stores that value at a row and column calculated according to the equations:

$$R=[\text{TTI of } 2\ (Y/3)]+P1$$

$$C=LNB\{[(\text{TTI of } Y \bmod 3)\ 341]+[\text{TTI of } X/3]\}$$

where:

TTI means truncation to an integer

LNB means lower nine order bits of P1 is "1" if [((X>511) and (Y mod 3=1)) or (Y mod 3=2)]

Likewise when circuit 524 transfers information form the VRAMS to the display, the mapping is done according to the above equations.

Figure 6:
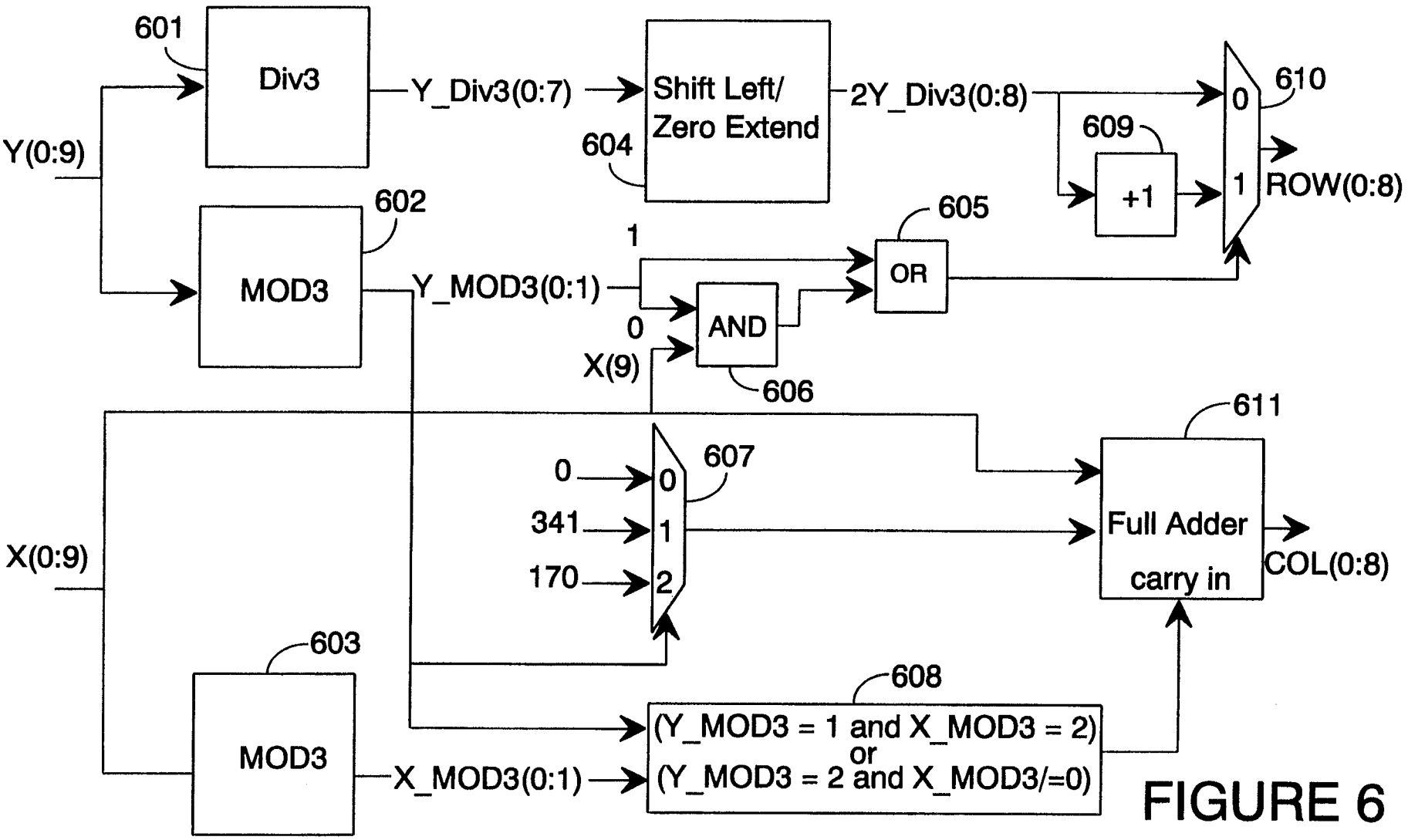
FIG. 6 is a block diagram of the VRAM addressing circuitry.

Logical circuit which generates the VRAM addressing according to the above equations is shown in FIG. 6. The circuit includes Divide by 3 circuit 601, Mod 3 translation circuits 602 and 603, divider circuit 604, AND and OR circuits 605 and 606, MUX selection circuits 607 and 610, full adder 611 and logical circuit 608.

The input to the circuit is a conventional 20 bit address which has ten Y bits Y(0:9) and ten X bits X(0:9). Logic 609 divides the address on the ten Y input bits by "3" to produce an eight bit number Y_DIV3(0:7). Logic 602 and 603 generate the mod 3 representation of the ten X and the ten Y bits. The mod 3 representations are two bits wide and they can have values of "0", "1" and "3". These values are referred to as Y_Mod3(0:1) and X_Mod3(0:1).

The Y_Div3(0:7) signal is divided by 2 by circuit 604 (a left shift with zero extend). Multiplexor 607 receives the output of Mod3 circuit 602 which can have one of three values and in response thereto selects one of the three inputs "0", "341" or "170" And circuit 606 and 0R circuit 605 are responsive to the two bit YMod3(0:1) signal to generate a select bit for MUX 610 which selects either the output of circuit 604 or that output incremented by "one" by circuit 609. The "1" bit of the Y_Mod3(0:1) signal goes to OR circuit 605 and the "0" bit goes to AND circuit 606.

Logical circuit 608 generates a carry input to the full adder circuit 611 if either one of two conditions are met. The carry is generated if either (a) Y_Mod3=1 and X_Mod3=2) or if Y_Mod3=2 and X_Mod3 is not equal to 0.

It a should be noted that the logical circuit shown in FIG. 6 is only one of many ways of generating the address bits ROW(0:8) and COL(0:8) from the twenty bit input address Y(0:9) and X(0:9). Other logical circuits could be used to generate the same address translation. The particular address translation is that shown in FIG. 4A.

While the invention has been shown herein as applied to a screen with 1024 columns and 768 rows using three way interleaving, the asymmetrical interleaving of the present invention can be applied to any video subsystem where the X dimension of the display is not an exact multiple the interleave factor of the memory subsystem. For example in the specific embodiment shown herein the X dimension of the display is 1024 and three way interleaving is used. Note, it is not possible to evenly divide 1024 by 3, hence, the invention is applicable.

While the invention has been shown with respect to a preferred embodiment thereof, it should be recognized that various changes in form and arrangement are possible without departing from the spirit and scope of the invention. The applicant's invention is limited solely by the appended claims.

What I claim is:

1. A video subsystem including a display, a video memory which has rows and columns, and means for mapping and interleaving the pixels between the display and the video memory according to the following formula:

$$R=(\text{TTI of } 2\ (Y/3))+P$$

$$C=LNB\{[(\text{TTI of } Y \bmod 3)\ 341)+(\text{TTI of } X/3)\}$$

where:

TTI means truncation to an integer

LNB means lower nine order bits of P is "1" if (((X>511) and (Y mod 3=1)) or (Y mod 3=2))

2. The video subsystem recited in claim 1 wherein said display has a resolution of 1024 pixels by 768 pixels.

3. The video subsystem recited in claim 2 wherein said video memory includes three two meg VRAMS and, said means for mapping and interleaving includes means for mapping all of the pixels on said display between said display and said three video rams.

4. The video subsystem recited in claim 3 wherein said means for mapping interleaving includes means for three way interleaving the data in said video memory.

5. The video subsystem recited in claim 1 wherein said means for mapping and interleaving includes means for three way interleaving the data stored in said video memory.

* * * * *